US011834287B1

(12) United States Patent
Rodriguez et al.

(10) Patent No.: US 11,834,287 B1
(45) Date of Patent: Dec. 5, 2023

(54) METHODS AND APPARATUS FOR IMPROVED WEB THREADING ACCOMODATION BY A PAPERBAND TURN-UP SYSTEM

(71) Applicant: Sandar Industries, Inc., Atlantic Beach, FL (US)

(72) Inventors: Peter A Rodriguez, Jacksonville, FL (US); Jason Rodriguez, Jacksonville, FL (US); Craig Austin, Jacksonville, FL (US); Richard Tyler Cernich, Jacksonville, FL (US)

(73) Assignee: Sandar Industries, Inc., Atlantic Beach, FL (US)

( * ) Notice: Subject to any disclaimer, the term of this patent is extended or adjusted under 35 U.S.C. 154(b) by 0 days.

(21) Appl. No.: 18/150,792

(22) Filed: Jan. 5, 2023

(51) Int. Cl.
*B65H 18/08* (2006.01)
*B65H 19/26* (2006.01)

(52) U.S. Cl.
CPC ..... *B65H 18/08* (2013.01); *B65H 19/262* (2013.01); *B65H 2408/23* (2013.01)

(58) Field of Classification Search
CPC ... B65H 18/08; B65H 19/262; B65H 2408/23
See application file for complete search history.

(56) References Cited

U.S. PATENT DOCUMENTS 2,461,246 A 2/1949 Theodore
4,659,029 A 4/1987 Rodriguez
4,711,404 A * 12/1987 Falk ..... B65H 19/262 242/542.3
4,757,950 A 7/1988 Rodriguez
4,783,018 A 11/1988 Rodriguez
5,046,675 A 9/1991 Rodriguez
5,417,383 A 5/1995 Rodriguez et al.
5,453,141 A 9/1995 Rodriguez
5,637,170 A 6/1997 Rodriguez
5,913,489 A * 6/1999 Rodriquez ..... B65H 19/262 242/526.2
5,954,290 A 9/1999 Rodriguez et al.
6,416,012 B1 * 7/2002 Wilmoth ..... B65H 19/262 226/166
6,467,719 B1 10/2002 Rodriguez
6,578,788 B2 6/2003 Rodriguez et al.
7,875,152 B2 1/2011 Rodriguez
8,124,209 B2 2/2012 Rodriguez
8,178,181 B2 5/2012 Rodriguez
8,580,062 B2 11/2013 Rodriguez

* cited by examiner

*Primary Examiner* — Sang K Kim
(74) *Attorney, Agent, or Firm* — TRACNIK LAW PLLC; Joseph P. Kincart

(57) ABSTRACT

Apparatus and methods for improved turn-up procedures on a paper making machine that include a flexible portion of a turn-up tape track and movement of a track curve portion to avoid interference with threading a paper web to a spool. A transverse turn-up tape track may be extended across a first spool to a track curve and the track curve may be set at a lower position that does not interfere with a paper web during threading, and subsequently repositioned to a position from which a turn-up position may be performed. The paper web threading leader may continue to be wound around the first spool until a full width of the paper web has been spooled onto the first spool. The transverse turn-up tape track may be maintained essentially stationary relative to the first spool.

20 Claims, 11 Drawing Sheets

METHODS AND APPARATUS FOR IMPROVED WEB THREADING ACCOMODATION BY A PAPERBAND TURN-UP SYSTEM

FIELD OF THE INVENTION

The present invention relates generally to apparatus and methods for more reliable and consistent high-speed severing and transfer of a rapidly advancing Paper Web from a rotating Full Spool onto an Empty Spool, and more particularly to apparatus and methods for arranging a turn-up system to accommodate web threading devices.

BACKGROUND OF THE INVENTION

The modern industrial paper making machine includes a continuous manufacturing process that forms a sheet of paper and winds the newly formed sheet of paper on a steel spindle or Spool sometimes coated with rubber or covered with a fibrous sheath spinning with significant force as the paper roll reaches a desired maximum diameter. In order to transfer a newly formed web of paper from a First Spool with full roll of paper to an Empty Spool that will continue to wind the paper requires a Turn-up Process. The Turn-up Process severs the moving web of paper and transfers it to the Empty Spool. Typically, a transfer turn-up tape is extended across a width of the newly formed paper roll and used to sever the paper.

Modern paper manufacturing is typically performed by producing continuous lengths of paper having widths of over 400 inches in some cases, referred to as Paper Webs, which are wound onto Web Spools for subsequent converting, storage, transfer or the like.

Methods and apparatus describing severing and transfer, utilizing what is known as a Transfer Tape or turn-up tape, are described, for example in U.S. Pat. No. 2,461,246 to Weyenberg, issued in 1949. Other examples are shown in our U.S. Pat. Nos. 4,659,029, 4,757,950, 4,783,018, 5,046,675, 5,453,141, 5,637,170, and 5,954,290. Further examples and detailed discussion of such equipment, systems and methodologies are present in our U.S. Pat. Nos. 4,659,029, 4,757,950, 4,783,018, 5,046,675, 5,417,383, 5,453,141, 5,637,170, 5,954,290, 6,467,719, 6,578,788, 7,875,152, 8,124,209, 8,178,181 and 8,580,062, the disclosures of which are incorporated herein by reference.

Paper-making machines produce webs of paper many feet wide which follow a tortuous path around many rolls. It is inconvenient to thread the full-width web through the paper making machine when starting up. Rather, the web is reduced to a narrow strip on one side of the paper making machine, and it is entangled in ropes or passed from one narrow conveyor to another until the 'leader' has been pulled along the entire path through the machine. Once the leader has been drawn through the machine, the Paper Web is increased to the width desired. The inside edge traverses the paper making machine, and the near edge moves into the operational limit.

Typically, a narrow Threading Leader, and the Threading Ropes or conveyor sections lie outside the edge of the trim as it will be in production. It is important to note that the Threading Leader, ropes, and conveyors are outside an arc of the turn-up system's curve. Consequently, in order for the web to widen after threading, it must avoid the curved section of the turn-up system track in order to avoid cutting the curve, rendering the turn-up system inoperable.

Ordinarily, the turn-up system dispenser is mounted on the tending side of a paper making machine. Threading systems are also mounted on the tending side for the convenience of the operators. This places the curve section of the turn-up system track at the opposite, or drive side, of the paper making machine, in which case, no interference occurs between the threading process and the Track Curve.

However, in some cases, a Turn-up Dispenser must be mounted on the drive side of the paper making machine due, for example, to a placement of mechanical components of the paper making machine, control panels, infrastructure, and building elements. In such cases, the Track Curve is on the same side of the paper making machine as the ropes or conveyors, giving rise to interference between the paper threading process and the Track Curve.

It has been known to address the interference by moving an entire transverse track and curve as a unit, lowering the curve to a position below the plane of the Paper Web by pivoting the track at the opposite side of the paper making machine. This method of addressing the interference requires that the dispenser unit, when supported only by its attachment to the transverse track, be moved in unison with the track and curve.

Two limitations constrain this solution. The first and foremost is that moving an entire transverse track and curve as a unit, and lowering the curve to a position below the plane of the Paper Web is not always possible given the placement of paper making machine components, infrastructure, and mounting pedestals, which prevent vertical movement of the transverse track.

Another limitation that constrains moving an entire transverse track and curve as a unit, and lowering the curve to a position below the plane of the Paper Web, is the considerable mass and power of the mechanisms needed to support and move the transverse track and curve. Maneuvering such mechanisms in a proximity to the paper making machine components is often difficult, if not impossible.

Therefore, a need exists to efficiently and conveniently address the interference between a paper threading process and the Track Curve.

SUMMARY OF THE INVENTION

Accordingly, the present invention provides apparatus and methods eliminating interference of a curved portion of a turn-up tape track while threading and widening of a Paper Web and placing of the curved portion of the turn-up tape track in a position allowing for an effective Turn-up Procedure. According to the present invention, the curved portion of the turn-up tape track is moved out of the plane of the web while threading, and returned to an operational position after threading and before a required Turn-up Procedure, without disassembly of the turn-up tape track. New apparatus are provided for movement of the curved portion of the turn-up tape track into respective positions for the disparate actions of threading a Paper Web, widening a Paper Web, and performing a Turn-up Procedure.

DETAILED DESCRIPTION OF THE INVENTION

Figure 1:
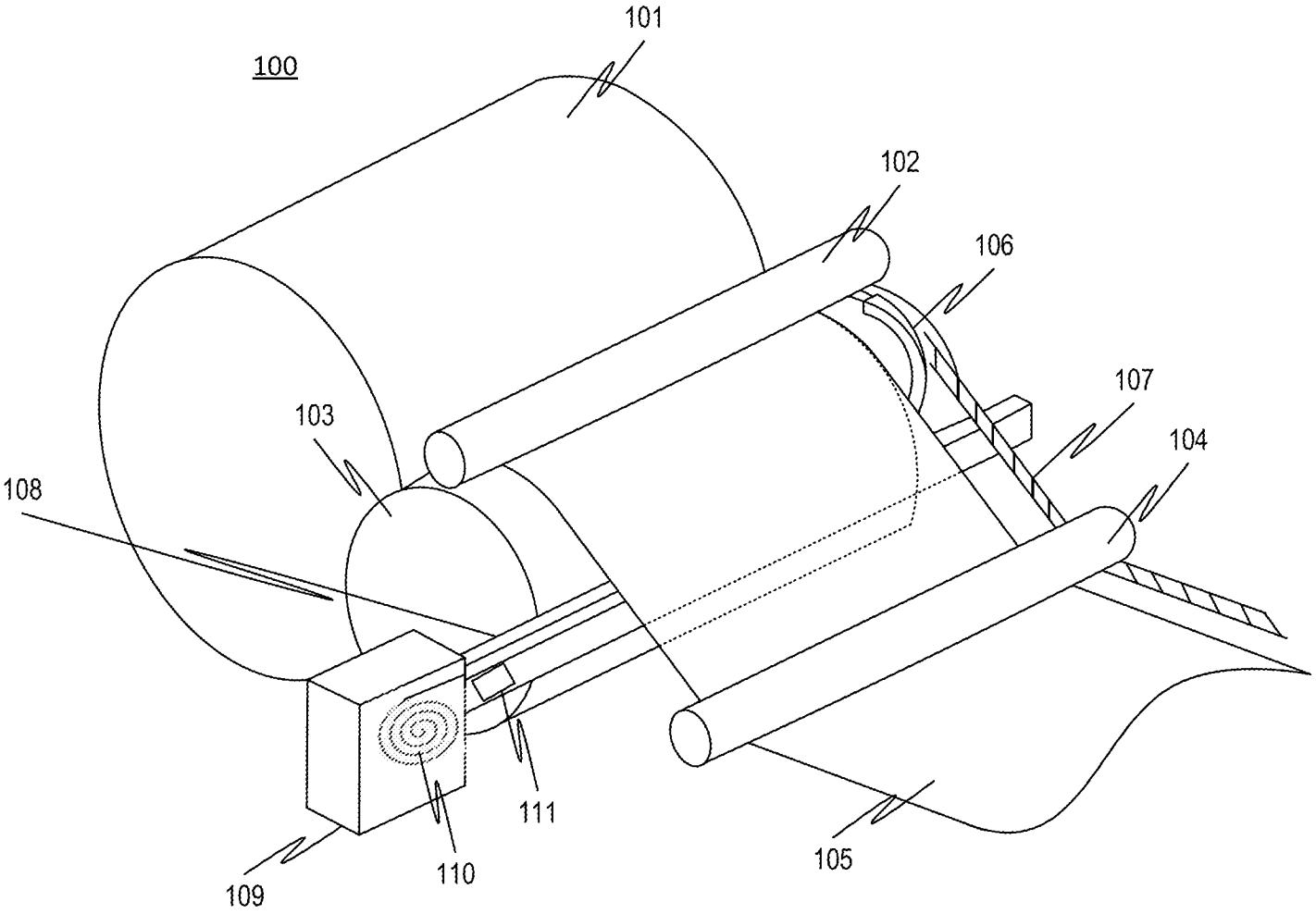
FIG. 1, illustrates a perspective view of a Parent Roll, an Empty Spool and a Paper Web with a Turn-up Dispenser.

The present invention provides methods and apparatus for mounting a turn-up system dispenser on a drive side of a paper making machine and relieves interference with a widening of a Paper Web during Paper Web production. The turn-up system dispenser may be placed on a same side or on an opposite side of a paper making machine as moving elements of the paper making machine, such as, for example, ropes or conveyors used in a Paper Web production operation. The present invention provides for methods and apparatus for moving a curved portion of a Transfer Tape Track to a position that is clear of the plane of the Paper Web while threading the Paper Web, and returning the curved portion to an operational position after threading of the Paper Web and prior to performance of a Turn-up Procedure.

Glossary

Composite: as used herein a Composite means an item made up of distinct parts or elements.

Empty Spool: as used herein an Empty Spool (sometimes referred to as an Empty Reel, a New Spool, a Reel Spool, Web Spool, or an Empty Spool), means a Spool with a Spool Face essentially devoid of Paper Web. The Spool Face is suitable for a Paperband Composite wound to be around, and removably attached to. The Spool Face of an Empty Spool is commonly used to adhere a Transfer Tape upon and receive Paper Web transferred from being accumulated onto a Full Spool.

Full Spool: as used herein a Full Spool (which may sometimes be referred to as an Old Spool, a Parent Web Spool, Full Web Roll, and/or a Full Roll), refers to a Web Spool that is substantially nearing its capacity for holding Paper Web.

Nip: as used here Nip refers to the area where a Paper Web or sheet is pressed between two Rolls/Spools.

Paperband: as used herein, a Paperband (sometimes referred to as a Turn-up Tape, Transfer Tape or Paper Band), refers to a substrate adapted for extending across a longitudinal cylindrical surface of one or both of an Empty Spool and a paper bearing Web Spool. A Paperband may include multiple layers.

Paperband Composite: as used herein means a Paperband with a first side and a second side, the first side having at least one layer of adhesive. A Paperband Composite may include multiple distinct elements and/or parts.

Paper Web: as used herein refers to a newly formed continuum of paper that is processed and rolled on a paper making machine.

Reel Drum: as used herein a Reel Drum refers to a Spool used to drive movement of a Paper Web; in some embodiments a Reel Drum may impart rotational movement to a Web Spool (such as a Parent Roll) receiving a Paper Web in a reeling action.

Transfer Tape: as used herein a Transfer Tape (sometimes referred to as a turn-up tape, or Paper Band), refers to a substrate adapted for extending across a longitudinal cylindrical surface of one or both of an Empty Spool and a paper bearing Web Spool. The Transfer Tape may include multiple layers.

Transfer Tape Track: as used herein means an apparatus for containing a Transfer Tape while the Transfer Tape is extended laterally across a paper making machine prior to a Turn-Up Procedure.

Turn-Up: as used herein, a Turn-Up means a process involving switching a Paper Web from spooling on a nearly completed Full Spool to spooling on an Empty Spool. A Turn-up Process may include severing a Paper Web from a rotating parent web roll nearing its capacity to hold paper, transferring the Paper Web to an Empty Spool, and securing the Paper Web to the Empty Spool.

Web Spool: as used herein a Web Spool means a metal roll onto which a web, such as, for example a Paper Web, is wound during a reeling operation. A Web Spool may also be referred to as a Reel Spool. A Web Spool may include an Empty Spool, a Full Spool, and/or Parent Roll.

The invention in various embodiments in a broad and general sense includes apparatus and methods for conducting a Paper Web turn-up operation. The processes provide for improved turn-up operations enabling a continuous Paper Web being rolled onto a first Web Spool to be severed and transferred to a Second Spool, e.g., an Empty Spool. Typically, the transfer of the Paper Web from a first Web Spool to a second Web Spool is performed as the first Web Spool approaches being fully wound. In the operation, such a transfer occurs without requiring a flow of the Paper Web to be significantly altered or stopped. The drawings are provided herein for descriptive and illustrative purposes, and are not meant to limit the scope of the invention.

Referring to FIG. 1, a schematic diagram illustrates components included in a paper making machine 100 apparatus for performing a Paper Turn-Up Process. An Empty Spool 102 is positioned to take up the Paper Web 105 during a Turn-up Procedure during which the Paper Web 105 is transferred from being wound around the Full Spool 101, to being wound around the Empty Spool 102. A Turn-up Tape 110 is coiled in a Turn-up Tape Dispenser 109. A Feed Actuator 111, or other manual or automated feeding device, may feed the Turn-up Tape 110 through a Transverse Turn-up Tape Track 108 and into a Track Curve 106. The Track Curve 106 needs to be kept clear of one or more Threading Ropes 107 that may run along a length of the Paper Web 105. The Paper Web 105 may be guided by a Lead-in roll 104. The Paper Web 105 may be run over a top of a Reel Drum 103 and into a nip between the Reel Drum 103 and the Full Spool 101 (which is named a full spool for the discussion of this invention but may begin in a state without any paper web spooled onto it) onto which the Paper Web 105 will be wound. The Paper Web 105 may be attached to the Full Spool and the Paper Web 105 may be spooled onto the Full Spool 101 eventually progressing from a paper web threading leader 303 to a full width of Paper Web 105 being spooled. After the full width of Paper Web 105 has begun being spooled on the Full Spool 101, the Track Curve 106 position may be transitioned to a turn-up position.

As illustrated, a Full Spool 101 may be positioned proximate to an Empty Spool 102 such that the Full Spool 101 and the Empty Spool 102 have respective surfaces that are essentially parallel to each other in relation to a Paper Web 105 being threaded under a Lead In Roll 104 and over a Reel Drum 103 with a Curved Track portion 106 adjacent to one or more Threading Ropes 107.

During a turn-up process, the Track Curve 106 may be placed in a first position. At a time during which a paper web 105 is being threaded onto an Empty Spool 102 (which eventually receives sufficient paper web to become a Full Spool 101) the Track Curve 106 may be positioned in a second position to avoid interference with transversely threading of the Paper Web 105 onto an Empty Spool 102. In some preferred embodiments, a change from the first position to the second position may be accomplished by flexing a flexible track portion 112.

In some exemplary procedures, an operator of a Paper Making Machine 100 with an associated Turn-up Tape Dispensing Apparatus 109 may begin with initiation of a load cycle by closing a load switch or other actuator that controls conveyance of a Turn-up Tape 110 through a Turn-up Tape Track 108. The Paper Making Machine 100 produces a Paper Web 105 that is threaded onto a Full Spool 101.

At a point in time prior to a time that the Full Spool 101 becomes filled to capacity with Paper Web 105, the Turn-up Tape Dispenser 109 will be prepared for a Turn-Up Procedure, which includes proper placement of a Paperband 110 in a Turn-up Tape Dispenser 109 and loading into the Transverse Turn-up Tape Track and a Track Curve 106. A feed of the Turn-up Tape 110 may be initiated prior to a Turn-up Process. In some embodiments, controls for feeding the Turn-up Tape 110 may be integrated with other control systems on the other portions of the Paper Making Machine 100. Thus, initiation may be integral with the operation of the Paper Making Machine 100, or may occur in response to an operator action of a control specific to loading the Turn-up Tape 110, such as, for example, actuating a switch or pressing a button.

A Feed Actuator 111 may cycle to advance the Turn-up Tape 110 through the Transverse Turn-up Tape Track 108 to the Track Curve 106 into a position for attaching to an Empty Spool 102. The Feed Actuator 111 may have a programmed amount of stroke to move the Turn-up Tape 110, which may depend on aspects of the Paper Making Machine 100 such as, for example, the Paper Making Machine's 100 width, Paper Web 105 speed, Spool Diameter 101-102 or Reel Drum diameter 103.

In some embodiments, a sensor may be used to detect an end of stroke of a piston deploying the Turn-up Tape 110, following which a Turn-up Process may occur. After the Turn-up Process is completed, the Feed Actuator 111 may reset to prepare for a next turn-up operation.

Figure 2:
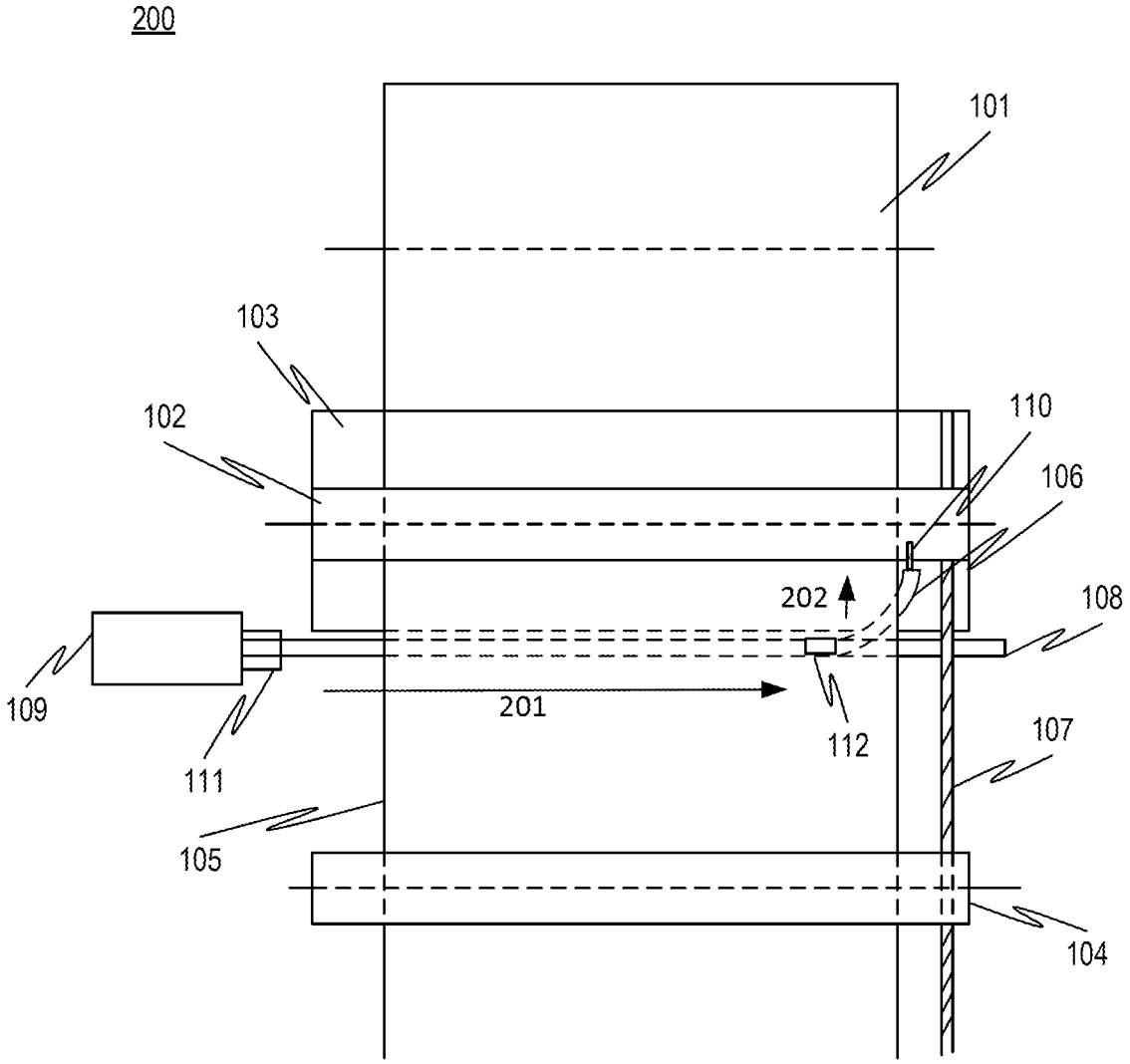
FIG. 2 illustrates a top down view of a Parent Roll, an Empty Spool, and a Paper Web with a Turn-up Dispenser.

Referring now to FIG. 2, a top down view illustrates a Lead-in Roll 104 with a Paper Web 105 in mechanical communication with a Full Spool 101 and a Reel Drum 103. An Empty Spool 102 is positioned proximate to the Full Spool 101 such that the Empty Spool 102 may receive a Paper Web 105 transferred from being wound around the Full Spool 101 to being wound around the Empty Spool 102 via a Turn-up Procedure.

A Turn-up Dispenser is positioned to dispense Turn-up Tape 110 through a Transverse Turn-up Tape Track 108 that is transverse across the Paper Web 105. The Transverse Turn-up Tape Track 108 is connected to a Track Curve 106 that is positioned to guide the Turn-up Tape 110 from a Transverse Direction 201 to a Turn-up Direction 202 that will cause the Turn-up Tape 110 to come into contact with the Empty Spool 102 and perform a Turn-up Procedure. According to the present invention, the Track Curve 106 is movable from a first position to a second position. Movement from the first position to the second position may occur via flexing a flexible track portion 112. The first position may generally interfere with transversely threading of the Paper Web 105 and may run under the Lead-in Roll 104, over the Transverse Turn-up Tape Track 108, over the Reel Drum 103, under the Empty Spool 102 and around the Full Spool 101. The ability to move to the second position provides for improved operation of the Paper Machine due to the placement of the Track Curve 106 in the second position removes the Track Curve 106 from interfering with threading of the Paper Web 105.

In the first position, the Track Curve 106 is in mechanical communication to receive the Turn-up Tape 110 from the Transverse Turn-up Tape Track 108 and guide the Turn-up Tape 110 to an exit of the Track Curve 106 sufficiently close to the Empty Spool 102 to successfully perform a Turn-up Procedure. Typically, while a Track Curve 106 is at a second position the Turn-up Tape 110 will not be guided to an exit from the Track Curve 106 that is suitable for a successful Turn-up Process.

Figure 3:
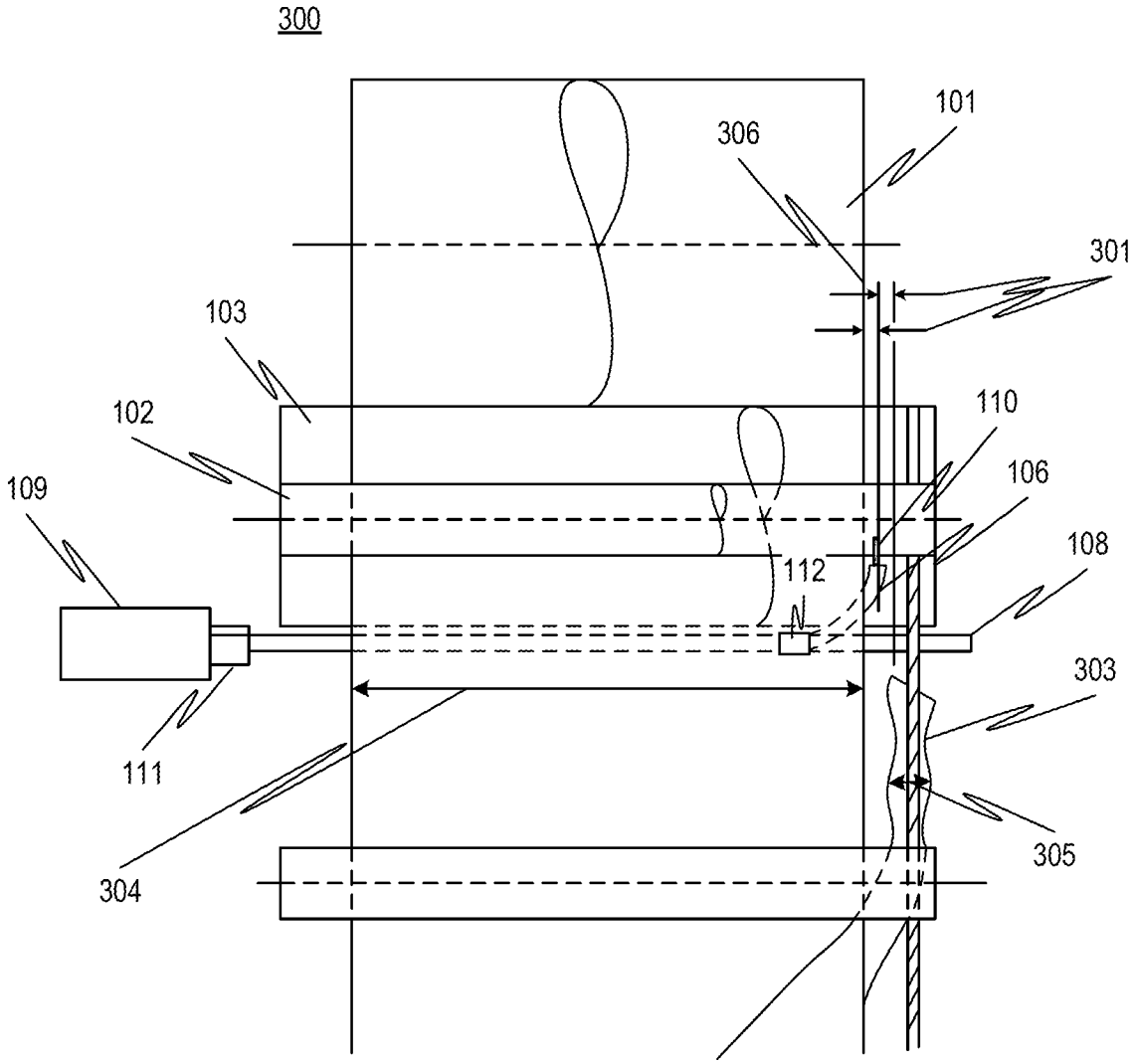
FIG. 3 illustrates a Paper Making Apparatus with a Threading Leader and Web width and position.

Referring now to FIG. 3, which illustrates a Paper Making Apparatus 300 with a Threading Leader 303. A Production Width 304 of a Paper Web 105 is illustrated in a Position 304 that is typical during Paper Web 105 production for comparison with a Threading Leader width 305 illustrated in an exemplary position during a threading of the Threading Leader 303. The Track Curve 106 is shown in a first position that is functional for conducting a Turn-up Procedure on a Paper Web 105 in a production width and position 305, however the Track Curve 106 in the first position occupies a space 301 between the Threading Leader 303 and trim 306 such that the Track Curve 106 is likely to interfere with threading of the Threading Leader 303. According to the present invention, the Track Curve 106 may be moved via a flexible track portion 112 to a position that does not interfere with the threading of the Threading Leader 303. Typically, the threading of the Threading Leader 303 is to be completed before the Paper Making Apparatus 300 may proceed with normal Paper Web 105 reeling.

Figure 4:
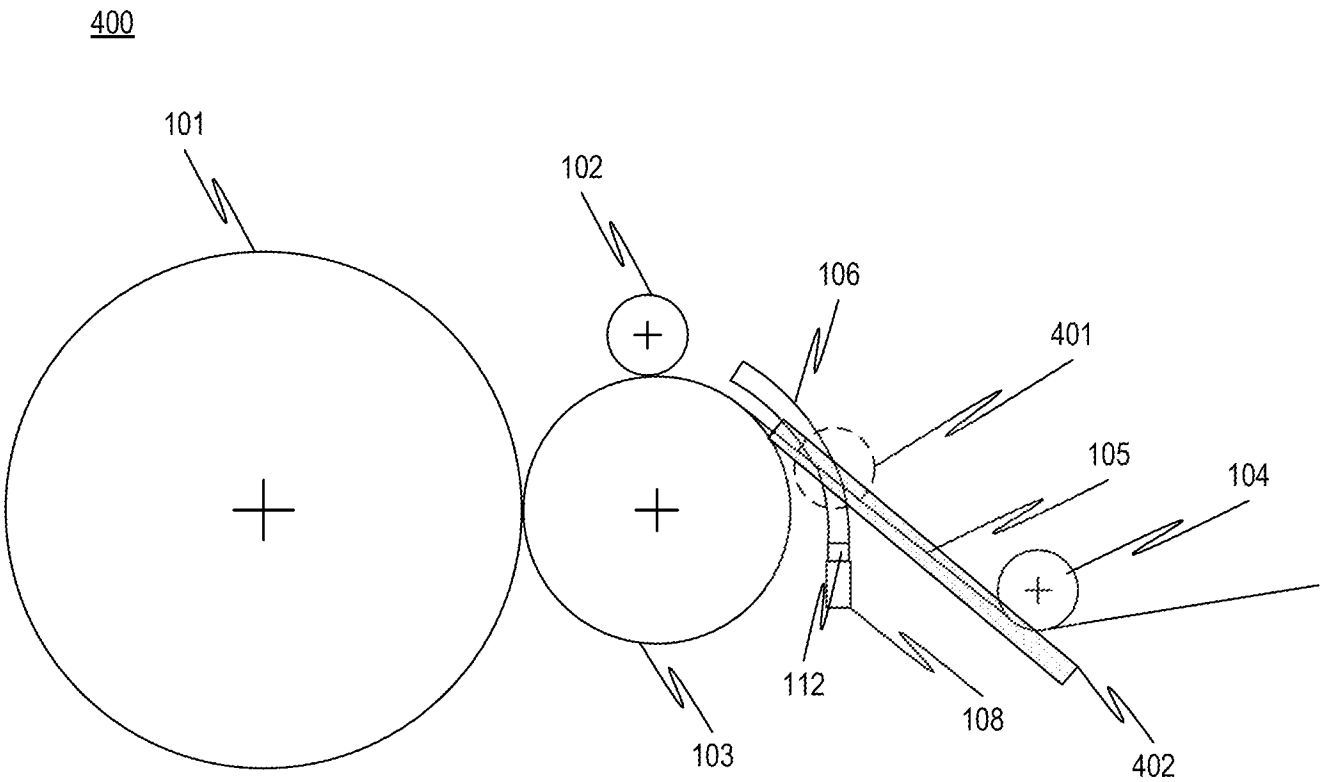
FIG. 4 illustrates an elevation view of a Paper Making Apparatus demonstrating a conflict of a Track Curve and a plane of a Paper Web and Threading Ropes.

Referring now to FIG. 4, an elevation view of a Paper Making Apparatus 400 illustrates a Region of Interference 404 in which the Track Curve 106 is placed while the Track Curve 106 occupies a first position. As illustrated, the Track Curve 106 occupying the first position conflicts with a Plane 410 of the Paper Web 105 as it is being threaded, and a position of Threading Ropes (not shown in FIG. 4). In order to proceed with normal Paper Web making processes, the Paper Web 105 is preferably threaded past the Transverse Turn-up Tape Track 108 and the Track Curve 106, over the Reel Drum 103, under the Empty Spool 102, to be wound on the Full Spool 101 (which begins in an empty state). As illustrated, the Region of Interference 404 creates an obstacle to threading while the Track Curve 106 is in a first position. The Track Curve 106 may be moved, such as for example via flexing as a flexible track portion 112 to avoid the Region of Interference 404.

Figure 5:
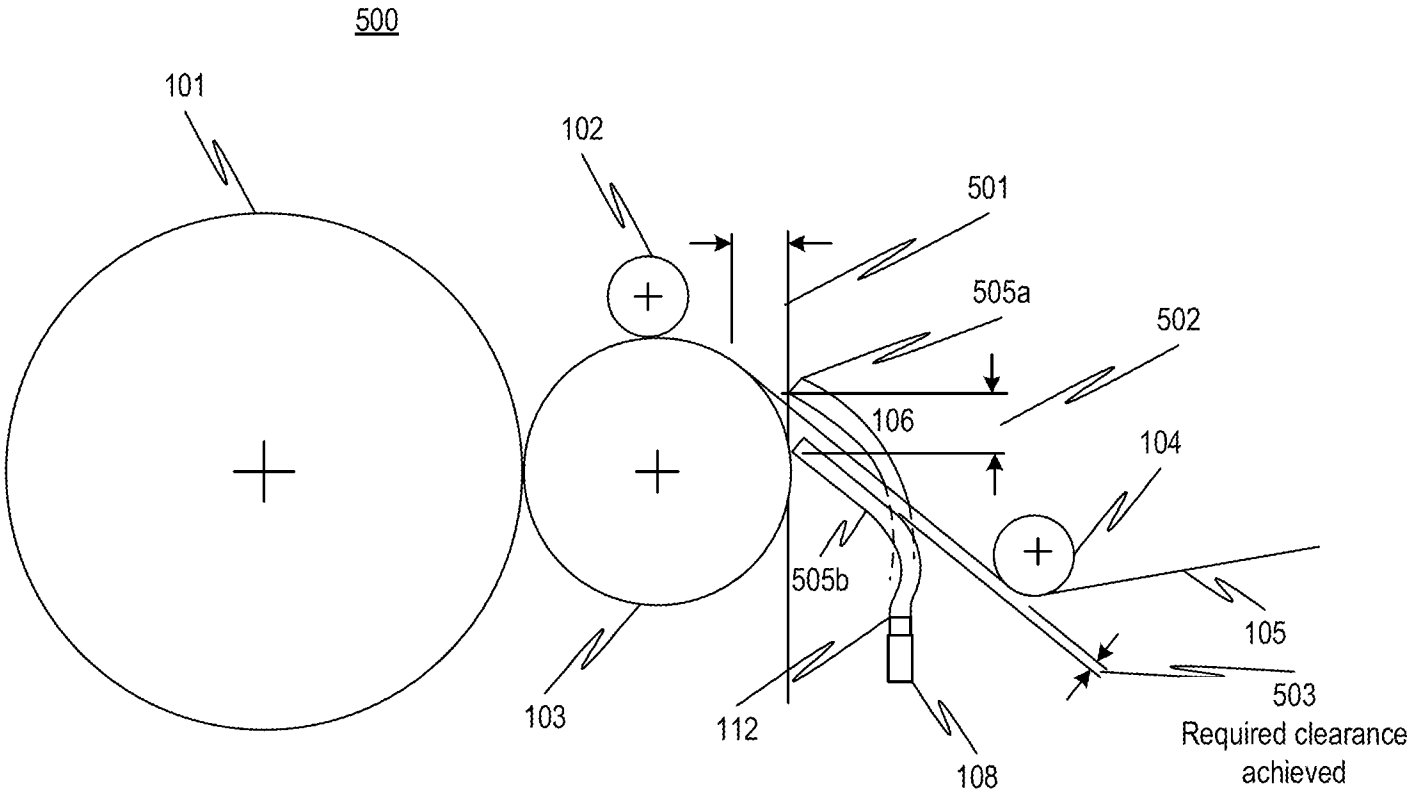
FIG. 5 illustrates an elevation view of a Paper Making Apparatus with the Track Curve lowered beneath the plane of the Paper Web.
Figure 5A:
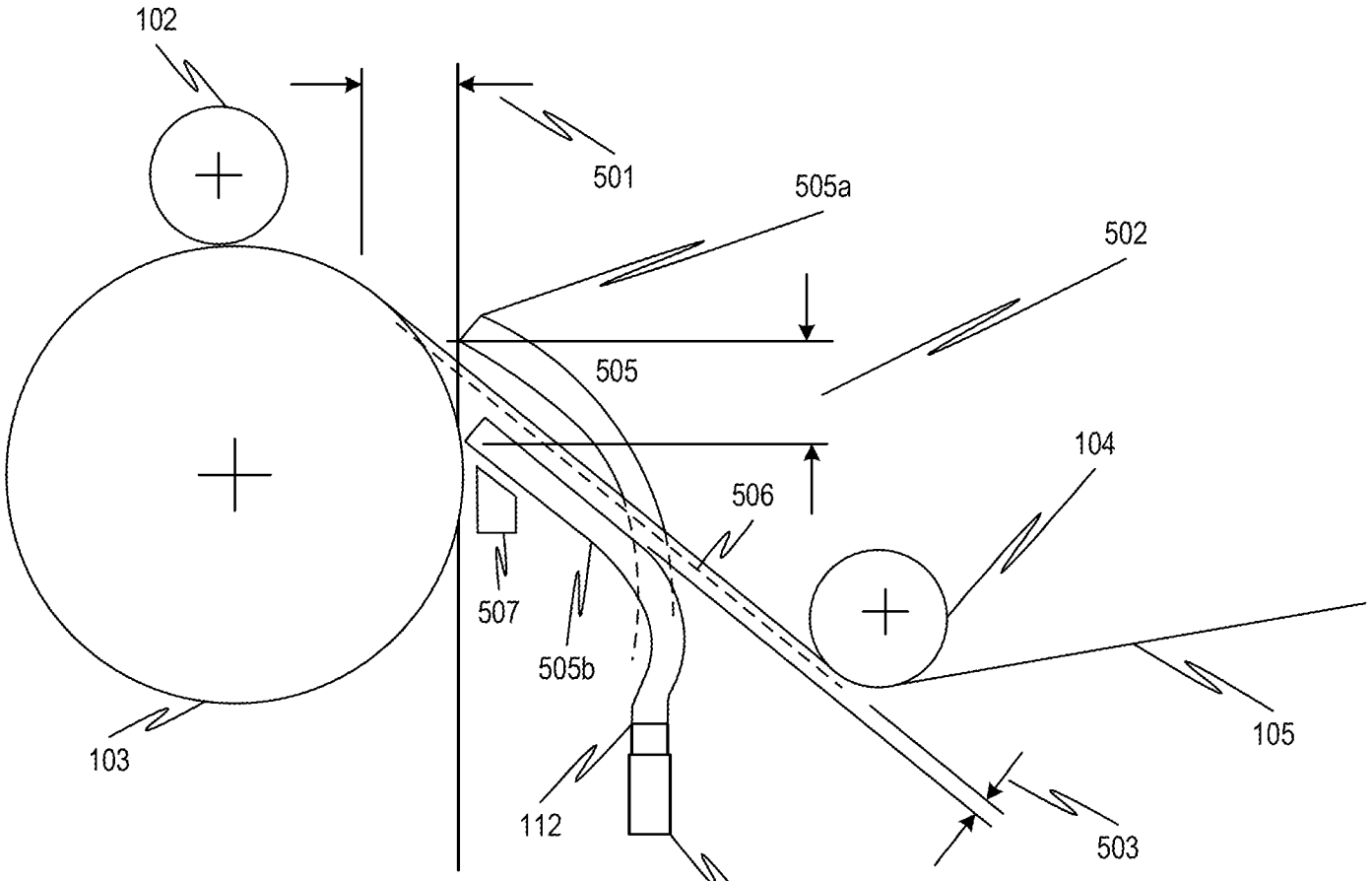
FIG. 5A illustrates a blown-up portion of a Paper Making Apparatus with the Track Curve lowered beneath the plane of the Paper Web.

Referring now to FIG. 5 and FIG. 5A a schematic view (FIG. 5) and a blown up portion (FIG. 5A) of a Paper Making Apparatus 500 according to some embodiments of the present invention are illustrated with a Flexible Track Portion 112 of a Track Curve 106 that permits an operator, or an automation, to lower the Track Curve 106 to a position beneath a plane of a Paper Web 105 until a Required Clearance 503 is achieved between the Track Curve 106 and the Paper Web 105 (or portion thereof, such as a Threading Leader of the Paper Web 105) while the Paper Web 105 (or portion thereof, such as a Threading Leader) is being threaded through various components of the Paper Making Machine 500. In some preferred embodiments, a Required Clearance 503 may be measured from a Plane 506 occupied by the Paper Web 105.

As illustrated, the Flexible Track Portion 112 includes a flexible, bendable, hinged, or otherwise moveable portion of a continuum of track components, including, for example, one or both of: the Transverse Turn-up Tape Track 108 and the Track Curve 106. The Flexible Track Portion 504 enables a human operator and/or an automation to move the Track Curve 106 between a Turn-up Position 505*a* and a Lowered Position 505*b*.

While the Track Curve 106 is located at a Lowered Position 505*b*, a Required Clearance 503 is achieved between the Track Curve 106 and a path of the Paper Web 105 and/or a portion of the Paper Web 105 comprising a Threading Leader (not illustrated in FIG. 5). Movement of the Track Curve 106 between the Turn-up Position 505*a* and a Lowered Position 505*b* traverses a Vertical Movement Distance 502.

In some embodiments, a Setback Distance 501 may be maintained to prevent the Track Curve 106 from contacting the Reel Drum 103. The Setback Distance 501 may be maintained via a Movement Containing Device 507, such as, one or both of a mechanical device and an electromechanical device positioned to prevent excessive Vertical Movement 502. The Movement Containing Device 507 may include a stop, shim, solenoid, or item effective to limit movement of the Flexible Track Portion 112.

Figure 6:
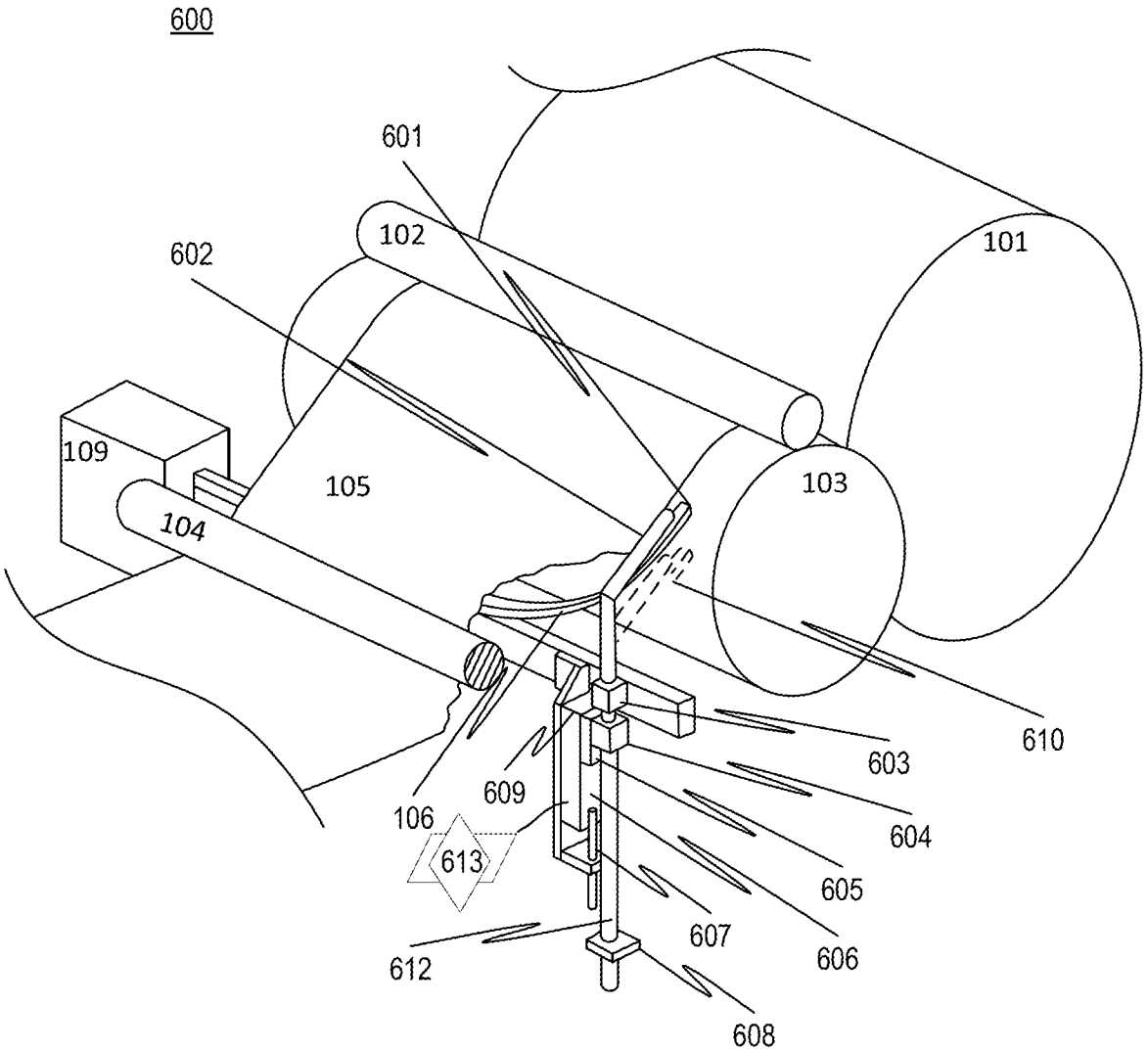
FIGS. 6, 6A, and 6B illustrate views of a Paper Making Apparatus with a Track Curve movable from a first position to a second position.

Referring now to FIG. 6, a schematic view of a Paperband-based Turn-up System 600 is illustrated in context with components of a Paper Making Machine. The Paperband-based Turn-up System 600 is shown in FIG. 6 with a Track Curve 106 in an upper ready position, which may be referred to as the Track Curve Turn-up Position 601. A Linear Actuator 606 is mounted to a Linear Support, which may include one or more of: a rail, a rack gear, a rod, a channel, or the like. A Carriage 605 is movable via operation of the Linear Actuator 606.

A Connector 604 is attachable to the Carriage 605 and a track curve bracketry 614 fixedly or removably attached the Track Curve bracket 602 thereby supporting the Track Curve 601. The Carriage 605 is movable along the Linear Actuator 606 via a Propulsion Mechanism 613 such as, by way of non-limiting example, one or more of: air or hydraulic cylinder, motor and lead screw, magnetic coupling, etc.) to which Track Curve Brackets 602 are attached to support the end of the Track Curve 106. Track Curve Brackets 602 may be used to orient the Track Curve 106 into a Track Curve Turn-up Position 601 that is suitable to direct the Turn-up Tape 110 into a nip between the Empty Spool 102 and the Reel Drum 103.

The Linear Actuator 606 may be retracted thereby lowering the Track Curve 106. In lowering the Track Curve 106, the Track Curve 106 may be removed from a position in which it interferes with a plane of the Paper Web 105, thus allowing a Threading Leader 305 (not illustrated in FIGS. 6-6B) to be widened without colliding with portions of the Turn-up Track, such as, for example, the Transverse Turn-up Tape Track 108, the Track Curve 106, and the Flexible Track Portion 504). Extending the Linear Actuator 606 raises the Track Curve 106, and positions Track Curve 106 in the Track Curve Turn-up Position which is suitable to perform a Turn-up Process.

Figure 6A:
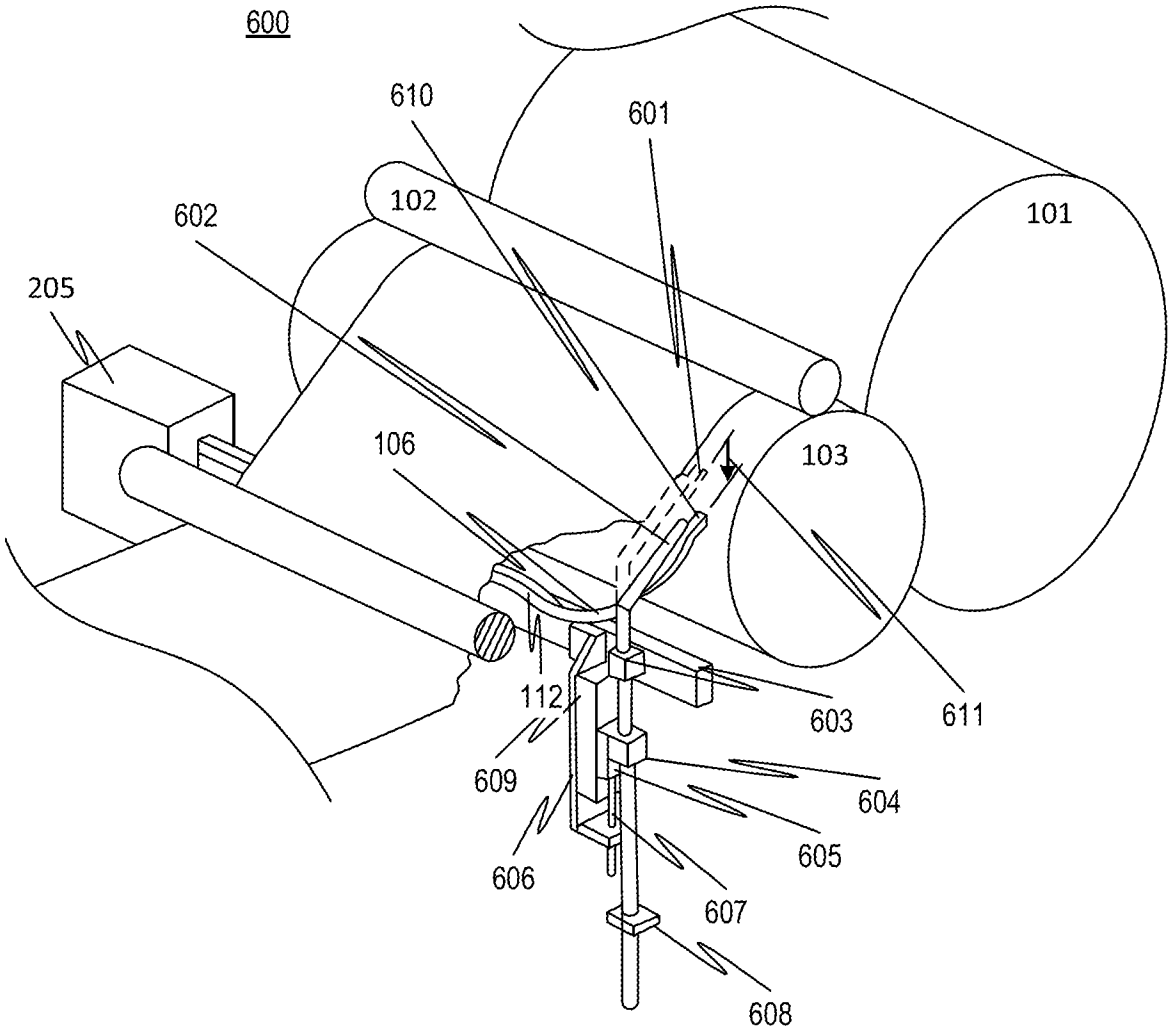

Referring now to FIG. 6A, a schematic view of a Paperband-based Turn-up System 600 illustrates a Track Curve 106 placed in a Track Curve Lower Position 610. The Linear Actuator 606 and Track Curve Bracketry 602 are mounted to the Transverse Track Support in a vertical orientation. Limits of travel of the Track Curve 106 may be integral to the Linear Actuator 606. In some preferred embodiments, limits of travel of the Track Curve 106 may include adjustable external stops, or a combination of integral and external stops.

In another aspect, in some embodiments, a Track Curve 106 may be cut to a length that prevents a tip (or other end) of the Track Curve 106 from contacting the Reel Drum 103 while the Track Curve is in the Track Curve Lower Position 610 or other retracted position.

In some embodiments, the Linear Actuator 606 may extend to position the Track Curve 106 for a Turn-up Procedure. In some various embodiments, a tip of the Track Curve 106 may be farther from the nip than preferred in a traditional static installation, however, adjustments may be made to one or more of: an angle of the Turn-up Tape 110 to the Empty Spool 102; a length of Turn-up Tape 110 extended from the Track Curve 106, a stiffness of the Turn-up Tape 110, or other variable to accommodate a distance of the Track Curve 106 may be farther from the nip.

In some preferred embodiments, the Track Curve 106 may include at least a portion fashioned with a flexible material, such as an extrusion of a slippery polymer. A length and positioning of the Track Curve 106 may be coordinated to allow the Track Curve 106 to be collapsed without kinking or distorting such that the ribbon may be pushed through it easily after repeated cycles.

Figure 6B:
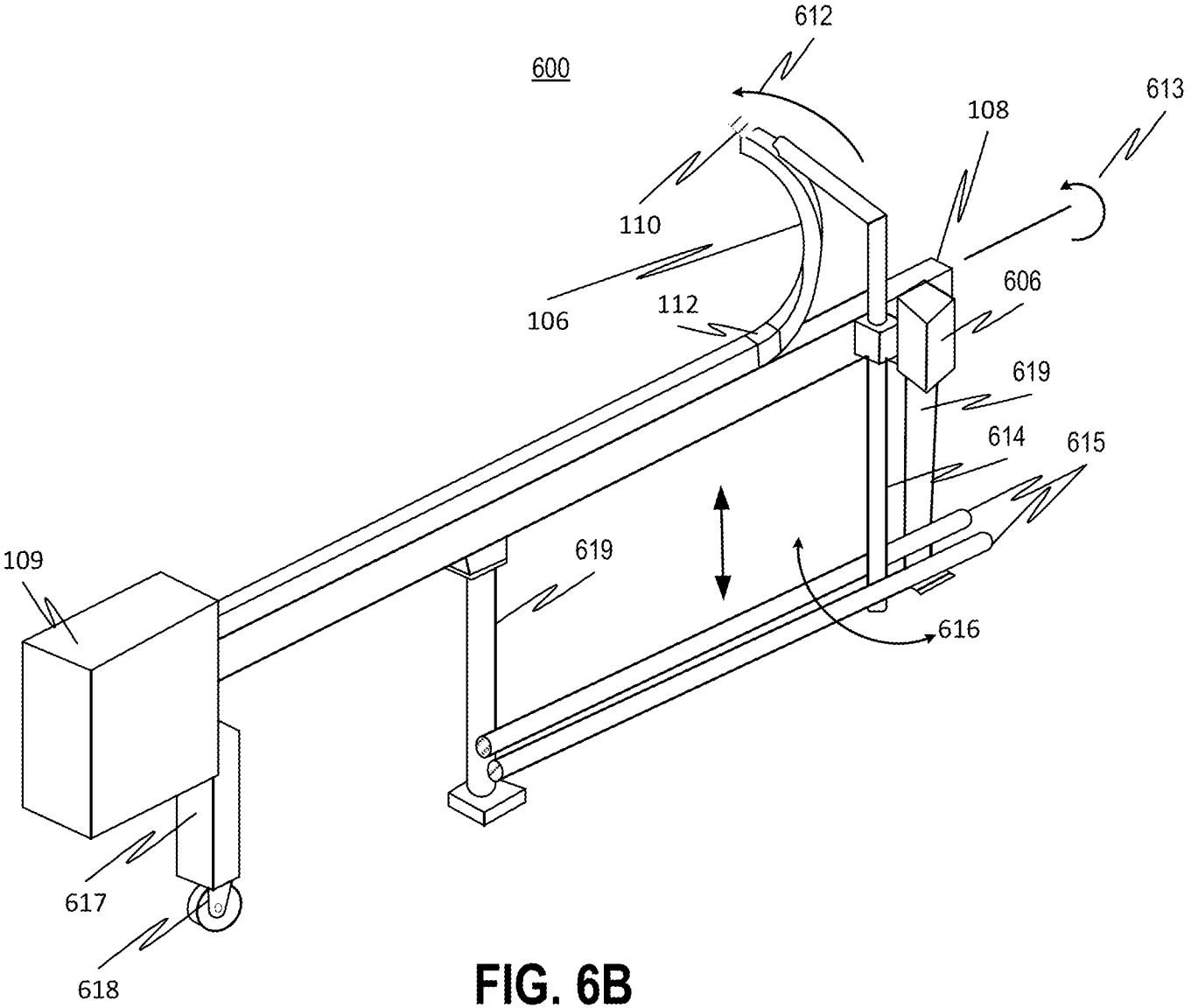

Referring now to FIG. 6B, a perspective schematic view of a Paperband-based Turn-up System 600 according to some embodiments of the present invention is illustrated with apparatus to limit and/or control an amount of Reactive Movement 612 of the Track Curve 106. A force to cause Reactive Movement 612 may be initiated during a Turn-up Procedure as the Turn-up Tape 110 is drawn out of the Track Curve 106 after attaching to a rotating Empty Spool 102 (not shown in FIG. 6B).

In some embodiments, a Track Curve 106 may be supported by bracketry mounted to elements of the Paper Making Apparatus 600. For example, the Track Curve Bracketry 602 may be fixedly attached to the Track Curve 106 at a first point and fixedly attached to the Carriage of the Linear Actuator at a second point, enabling the Track Curve 106 supported at multiple points to accommodate an extension and/or retraction force on the Track Curve 106. A force for Reactive Movement of the Track Curve 106 may be generated, for example, during a Turn-up Procedure, or at any time that Turn-up Tape 110 is drawn from the Track Curve 106.

In some embodiments, dynamics of a Paperband-based Turn-up System 600 on a Paper Machine tend to pull the tip of the curve toward the nip, which it is preferable to prevent. Deflection of the Track Curve 106 and the Track Curve Bracketry 602 may be apparent when sighting along a length of the Transverse Turn-up Tape Track 108 if the deflection manifests as a twisting of the Transverse Turn-up Tape Track 108 and rotation of the Track Curve 106 toward the Reel Drum 103 and Empty Spool 102. Deflection may be reduced and/or prevented with an extended Track Curve Bracketry 614 that continues to a point extension below a longitudinal axis of the Transverse Turn-up Tape Track 108 and is secure at an anchor point that permits vertical travel while resisting rotation. Although the dynamics of a turn-up will tend to pull the Transverse Turn-up Tape Track 108 and the Track Curve 106 closer to the Reel Drum 103, this is sufficiently resisted by the Transverse Track Support and Horizontal Bars 615 or other bracing that support the Transverse Turn-up Tape Track 108 from a floor or paper making machine frame.

Various Paper Making Machines often have components that very in multiple respects, therefore a Paperband-based Turn-up System 600 may be modified according to specifications of a particular Paper Making Machine. Accordingly, the description of the mounting hardware may vary significantly, but the desired movement of the curve track and the forces to be managed in drive-side turn-up installations may generally be treated in a similar manner.

In general, the invention described includes methods and apparatus for improved turn-up procedures that may include a transverse turn-up tape track extended across a first spool suitable for receiving a paper web, the transverse turn-up tape track sized to contain a turn-up tape. The apparatus for improved turn-up procedures may also include a track curve movable from a lower position that does not interfere with a paper web during threading of the paper web for attachment of the paper web, to a turn-up position placing the turn-up tape in position to attach to a second spool during a turn-up procedure. A flexible track portion may be located between the transverse turn-up tape track and the track curve. The flexible track portion is movable from a first position to a second position, or otherwise adjustable, to move the track curve from a lower position to a turn-up position (or other position), while the transverse turn-up tape track remains essentially stationary relative to the first spool. Essentially stationary may include minor movement of less than 10 centimeters, or other amount that will not interrupt a turn-up procedure or other procedure that requires a turn-up tape within the track curve to be positioned with a range of positions.

Implementations may include one or more of the following features. Apparatus where the track curve is movable from the lower position to the turn-up position after threading a paper web threading leader to the second spool and widening of the paper web threading leader. Apparatus additionally having a set-back device positioned to prevent the track curve from contacting a reel drum during track curve movement 611. Apparatus additionally having: a track curve bracket holding the track curve in position; a carriage attached to the track curve bracket; and a linear actuator operational to provide linear movement to the carriage and the track curve bracket, the linear movement being sufficient to move the carriage and the track curve bracket between the lower position and the turn-up position while the transverse turn-up tape track remains stationary relative to the first spool. Apparatus additionally having a propulsion mechanism to move the linear actuator. Apparatus additionally having a linear bushing contacting the track curve bracket to guide the movement of the track curve from the lower position to the turn-up position. Apparatus additionally having an external stop to limit downward vertical movement of the carriage. Apparatus additionally having a track curve bracket extension positioned along a transverse track support, and in contact with a track curve rotation limiter. Apparatus where the track curve rotation limiter may include a horizontal bar. Apparatus where the track curve rotation limiter limits reactive movement of the track curve along an axis of rotation parallel to the transverse turn-up tape track. Implementations of the described techniques may include hardware, a method or process, or a computer tangible medium.

Figure 7A:
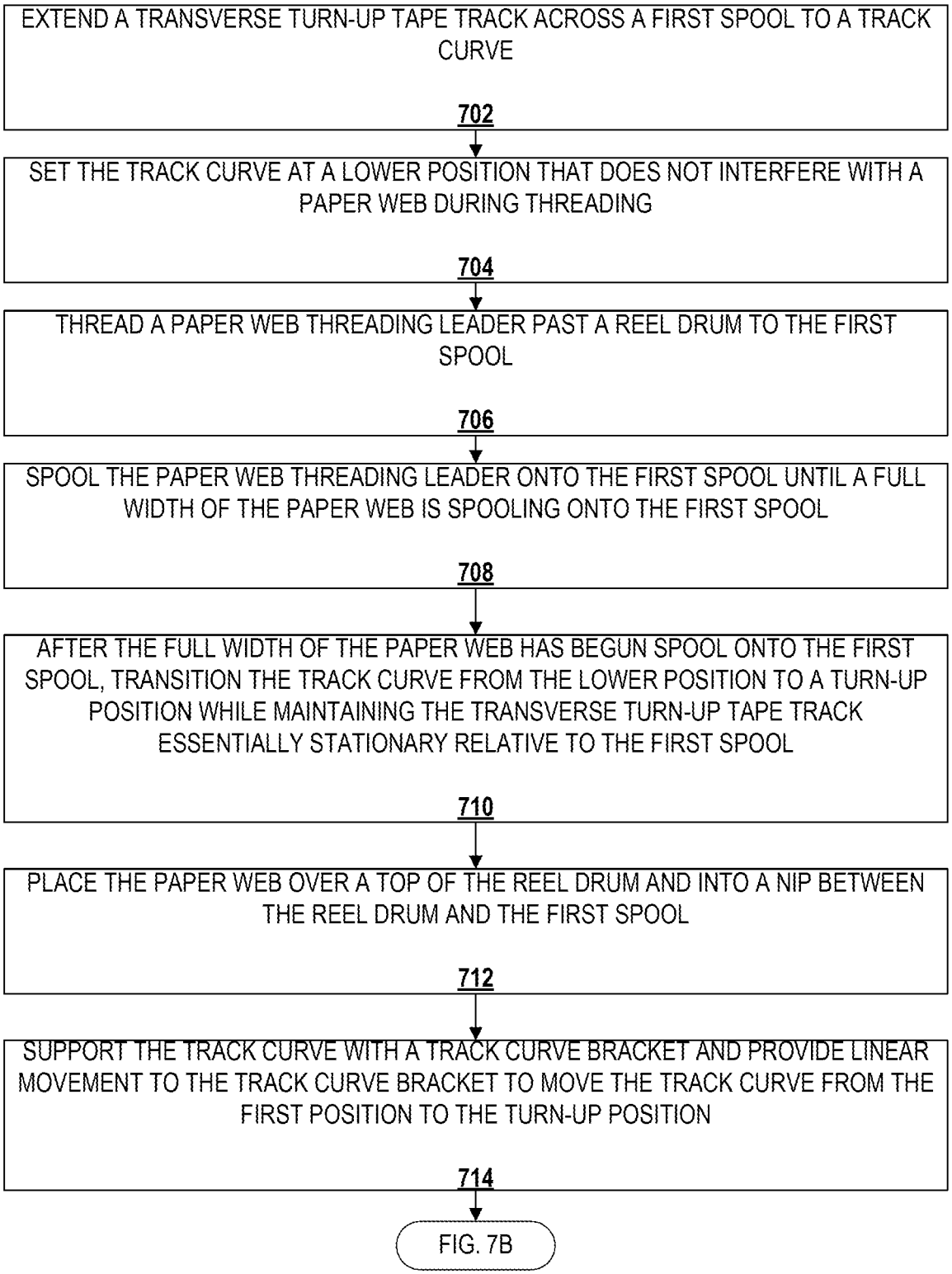
FIGS. 7A and 7B illustrate method steps that may be implemented in some embodiments of the present invention.
Figure 7B:
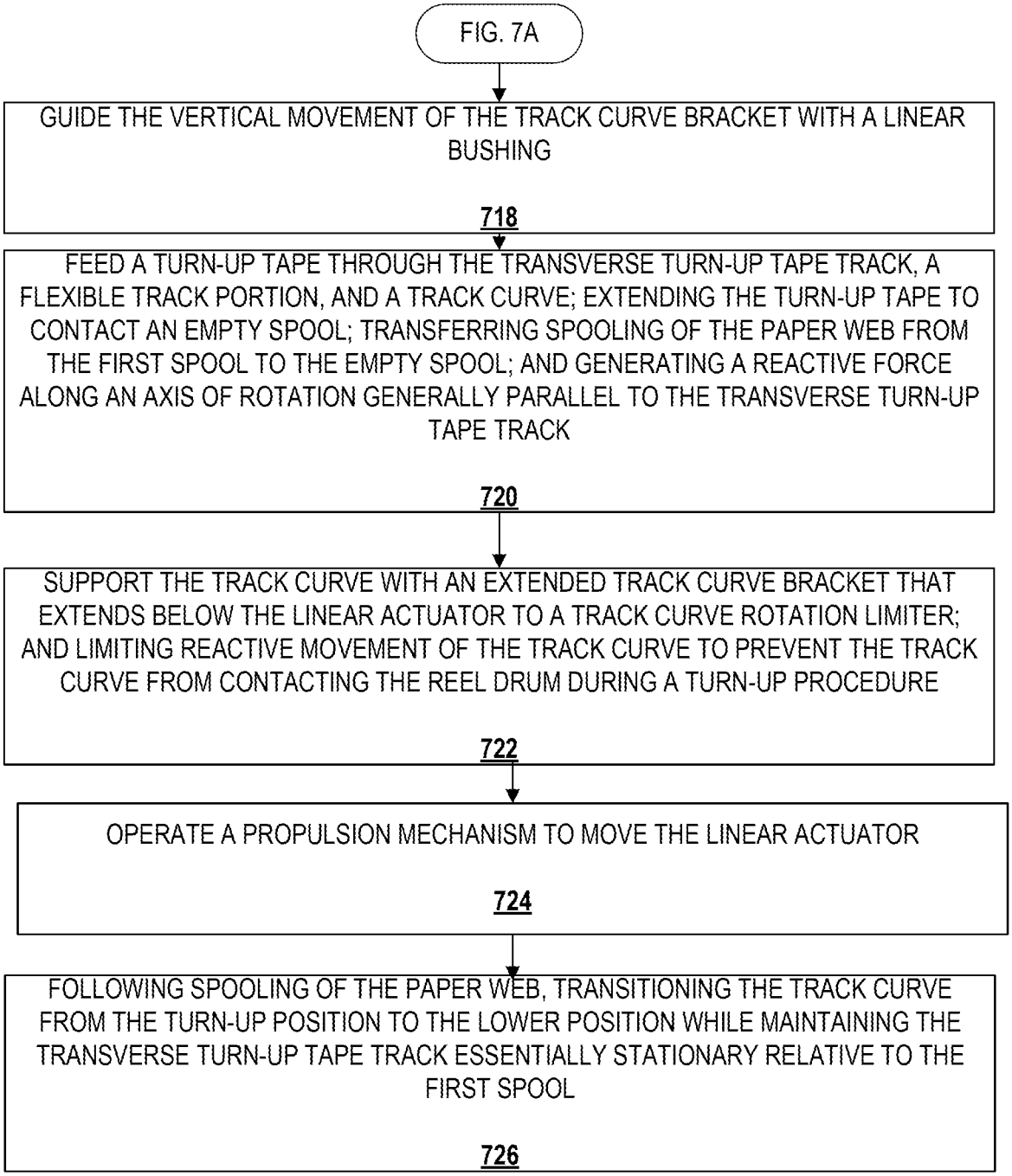

Referring now to FIGS. 7A and 7B, method steps that may be included in some embodiments of the present invention may include, at step 702 extending a transverse turn-up tape track across a first spool to a track curve; and at step 704 setting the track curve at a lower position that does not interfere with a paper web during threading.

At step 706 a paper web threading leader may be threaded past a reel drum to the first spool.

At step 708, the paper web threading leader may be spooled onto the first spool until a full width of the paper web is spooling (or otherwise conveyed) onto the first spool.

At step 710, after a full width of a paper web has begun spooling onto the first spool, the track curve may be transitioned from the lower position that does not interfere with the paper web during threading to a turn-up position, while maintaining the transverse turn-up tape track essentially stationary relative to the first spool.

At step 712, the paper web may be placed over a top of the reel drum and into a nip between the reel drum and the first spool; and at step 714 the track curve may be supported with a track curve bracket. At step 716 linear movement may be provided to the track curve bracket to move the track curve from the first position to the turn-up position, a linear actuator may be operated to provide the movement of the track curve from the first position to the turn-up position.

At step 718, the movement of the track curve from the lower position to the turn-up position with a linear bushing may be guided with a linear bushing.

At step 720, a turn-up tape may be fed through the transverse turn-up tape track, a flexible track portion, and a track curve; extending the turn-up tape to contact an empty spool; transferring spooling of the paper web from the first spool to the empty spool; and generating a reactive force along an axis of rotation generally parallel to the transverse turn-up tape track.

At step 722, the track curve may be supported with an extended track curve bracket that extends below the linear actuator to a track curve rotation limiter and limiting reactive movement of the track curve to prevent the track curve from contacting the reel drum during a turn-up procedure, the track curve rotation limiter may include a horizontal bar.

At step 724, a propulsion mechanism may be operated to move the linear actuator; and at step 726, using a set back device, the track curve may be prevented from contacting the reel drum during track curve movement. In some embodiments, the track curve may be transitioned from the turn-up position to the lower position that does not interfere with the paper web during threading, while maintaining the transverse turn-up tape track essentially stationary relative to the first spool.

Particular embodiments of the subject matter have been described herein. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted the terms "comprising", "including", and "having" can be used interchangeably.

Certain features that are described in this specification in the context of separate embodiments can also be implemented in combination in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

As has been mentioned, the illustrations depict aspects of exemplary embodiments, and the relative scale of illustrated features may be exaggerated for depiction of various aspects. Accordingly, the scale of features illustrated is not intended to limit the scope of the elements of the various embodiments consistent with the present application.

What is claimed is:

1. An apparatus for improved turn-up procedures on a paper making machine, the apparatus comprising:

a) a transverse turn-up tape track extended across a first spool for receiving a paper web, said transverse turn-up tape track sized to contain a turn-up tape;

b) a track curve movable from a lower position that does not interfere with the paper web during threading of the paper web for attachment of the paper web, to a turn-up position placing the turn-up tape in a position to attach to a second spool during a turn-up procedure; and c) a flexible track portion between the transverse turn-up tape track and the track curve, the flexible track portion being adjustable to move the track curve from the lower position to the turn-up position, while the transverse turn-up tape track remains stationary relative to the first spool.

2. The apparatus of claim 1, wherein the track curve is movable from the lower position to the turn-up position after threading a paper web threading leader to the second spool and widening of the paper web threading leader.

3. The apparatus of claim 2 additionally comprising a set-back device positioned to prevent the track curve from contacting a reel drum during movement of the track curve.

4. The apparatus of claim 2 additionally comprising: a track curve bracket holding the track curve in position; a carriage attached to the track curve bracket; and a linear actuator operational to provide linear movement to the carriage and the track curve bracket, the linear movement moving the carriage and the track curve bracket between the lower position and the turn-up position while the transverse turn-up tape track remains stationary relative to the first spool.

5. The apparatus of claim 4 additionally comprising a propulsion mechanism to move the linear actuator, the propulsion mechanism comprising one or more of: an air cylinder, a hydraulic cylinder, a motor and lead screw, and a magnetic coupling.

6. The apparatus of claim 4 additionally comprising a movement containing device positioned to limit movement of the track curve.

7. The apparatus of claim 6 wherein the movement containing device limits downward vertical movement of the carriage.

8. The apparatus of claim 6 additionally comprising a track curve bracketry attached to the track curve.

9. The apparatus of claim 8 wherein a track curve rotation limiter comprises a horizontal bar.

10. The apparatus of claim 9 wherein the track curve rotation limiter limits reactive movement of the track curve along an axis of rotation parallel to the transverse turn-up tape track.

11. A method for improved turn-up procedures on a paper making machine, the method comprising the steps of:

a) extending a transverse turn-up tape track across a first spool to a track curve;

b) setting the track curve at a lower position that does not interfere with a paper web during threading;

c) threading a paper web threading leader past a reel drum to the first spool;

d) spooling the paper web threading leader onto the first spool until a full width of the paper web is spooling onto the first spool; and e) after the full width of the paper web has begun spooling onto the first spool, transitioning the track curve from the lower position that does not interfere with the paper web during threading to a turn-up position, while maintaining the transverse turn-up tape track stationary relative to the first spool.

12. The method of claim 11 additionally comprising the steps of placing the paper web over a top of the reel drum and into a nip between the reel drum and the first spool.

13. The method of claim 12 additionally comprising the steps of supporting the track curve with a track curve bracket; and providing linear movement to the track curve bracket to move the track curve from a first position to the turn-up position.

14. The method of claim 13 additionally comprising the step of operating a linear actuator to provide the linear movement of the track curve from the first position to the turn-up position.

15. The method of claim 14 additionally comprising the steps of: limiting linear movement of the track curve from the lower position to the turn-up position with a movement containing device.

16. The method of claim 14 additionally comprising the steps of: feeding a turn-up tape through the transverse turn-up tape track, a flexible track portion, and the track curve; extending the turn-up tape to contact an empty spool; transferring spooling of the paper web from the first spool to the empty spool; and generating a reactive force along an axis of rotation generally parallel to the transverse turn-up tape track.

17. The method of claim 16 additionally comprising the steps of supporting the track curve with an extended track curve bracket that extends below the linear actuator to a track curve rotation limiter; and limiting reactive movement of the track curve to prevent the track curve from contacting the reel drum during a turn-up procedure.

18. The method of claim 17 wherein the track curve rotation limiter comprises a horizontal bar.

19. The method of claim 17 additionally comprising the steps of: using a set back device, preventing the track curve from contacting the reel drum during the linear movement of the track curve.

20. The method of claim 17 additionally comprising the step of following spooling of the paper web, transitioning the track curve from the turn-up position to the lower position that does not interfere with the paper web during threading, while maintaining the transverse turn-up tape track stationary relative to the first spool.

* * * * *